US005213403A

United States Patent [19]

Lautenschläger

[11] Patent Number: 5,213,403

[45] Date of Patent: May 25, 1993

[54] CORNER FASTENER FOR DRAWER GUIDES

[75] Inventor: Horst Lautenschläger, Reinheim, Fed. Rep. of Germany

[73] Assignee: Karl Lautenschlager GmbH & Co. KG Mobelbeschlagfabrik, Reinheim, Fed. Rep. of Germany

[21] Appl. No.: 773,144

[22] Filed: Oct. 8, 1991

[30] Foreign Application Priority Data

Oct. 12, 1990 [DE] Fed. Rep. of Germany ..... 4032426

[51] Int. Cl.[5] ..... A47B 88/00

[52] U.S. Cl. ..... 312/348.2; 312/140; 312/330.1

[58] Field of Search ..... 312/348.2, 348.1, 140, 312/330.1, 334.27, 334.31, 334.38, 334.42

[56] References Cited

U.S. PATENT DOCUMENTS

| | | | |
|---|---|---|---|
| 1,905,857 | 4/1933 | Hamilton | 312/330.1 |
| 2,857,233 | 10/1958 | Reiss et al. | 312/334.31 |
| 3,687,512 | 8/1972 | Alston | 312/348.2 |
| 4,090,753 | 5/1978 | Rock et al. | 312/140 |
| 4,173,380 | 11/1979 | Dupree | 312/330.1 |
| 4,470,647 | 9/1984 | Bishoff et al. | 312/140 |
| 4,653,821 | 3/1987 | Faust | 312/334.38 |

FOREIGN PATENT DOCUMENTS

| | | | |
|---|---|---|---|
| 1341399 | 12/1973 | United Kingdom | 312/348.2 |

*Primary Examiner*—Victor N. Sakran

[57] ABSTRACT

Corner fastener for the inside end of the runner rail of drawer guides. The corner fastener can be attached to the drawer where the drawer back and drawer side meet, and has clips projecting downward below the drawer bottom to snap onto the associated end of the runner rail. The fastener has a surface which can be laid flat against the drawer back, and it has a flange projecting at right angles between the end face of the drawer back and the confronting area of the drawer side. The flange is provided with means for fastening both to the end face of the drawer back and to the confronting area of the drawer side. These fastening means are constituted for example by studs which can be pressed into associated bores in the end face of the drawer back and in the drawer side.

9 Claims, 2 Drawing Sheets

Fig. 3
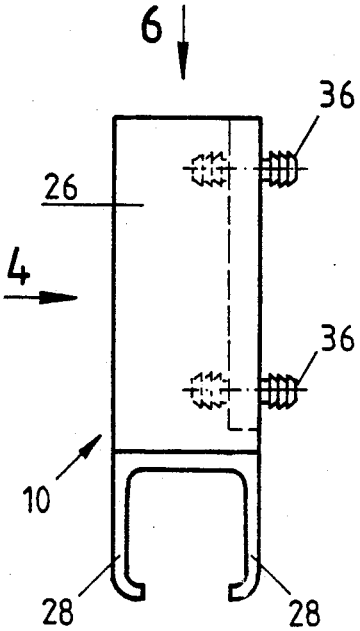
Fig. 4
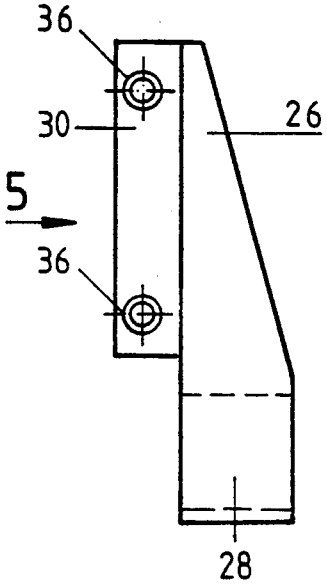
Fig. 5
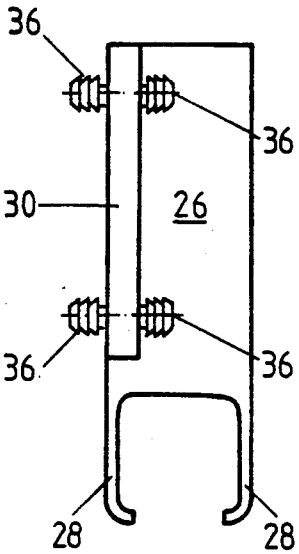
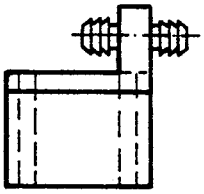
Fig. 6

CORNER FASTENER FOR DRAWER GUIDES

BACKGROUND OF THE INVENTION

The invention relates to a corner fastener for the inside end of the runner rail of drawer guides in which the guide rail to be fastened to the cabinet wall is engaged in the corresponding runner rail consisting of an inverted channel removably fastened to the bottom of the drawer and having on its interior tracks for rolling bodies which are held in an elongated cage and can roll on tracks formed by associated areas of the inside surface of the runner rail on the one side and, on the other side, on tracks formed by associated portions of the inside surface of the runner rail, thus permitting a longitudinal movement of the runner rail relative to the guide rail, a front-end corner fastener which can be fastened under the bottom of the drawer being associated with the front end of the runner rail and in which the front end of the runner rail is held, and the corner fastener that is to be fastened in the back corner of the drawer has two clips projecting downward below the drawer bottom, of which at least one clips onto the runner rail, the two clips being integral with a corner fastener which can be fastened in the back corner of a corresponding drawer and joins together the inside end of a drawer side and the associated end of the drawer back.

Drawer guides of the kind here in question have, on account of the great number of rolling bodies in the form of balls and/or rollers offset not only in the direction of drawer movement but also at right angles thereto, have in addition to easy running and great load bearing capacity the additional advantage that even in the fully extended state they have a high transverse stability, so that a drawer mounted thereby on a cabinet has no marked free transverse play even in the fully extended state. Consequently drawer guides of this kind are being used increasingly for mounting drawers in high-quality furniture. In comparison to rolling drawer guides which are likewise widely used but are more critical in the fully extended state, the drawer guides with rolling bodies of the kind here in question are more complex and accordingly expensive to manufacture. To be able to offer them on a price-competitive basis they have to be manufactured in larger series. This means, however, that only certain frequently used lengths of these drawer guides are available, while for drawers of the kind here in question with a depth different from the standard dimensions are not offered in precisely fitting lengths. The plastic cage holding the roller bodies between the guide rail and the runner rail and fixing them at their mutual distance apart requires that the length of movement of the drawer guides here in question is limited to a length that is shorter than the length of the corresponding drawer, so that the back of the fully extended drawer still remains inside of the corresponding cabinet by the length of the cage. That is to say, drawer guides of the kind here in question are so-called "part-length guides." Especially in the case of shallow drawers of very great length, the rear part of the drawer that in the extended state is still within the cabinet is harder to see and reach. It would therefore be desirable to make the drawer guides as so-called "full-length guides" in which the corresponding drawer can be drawn so far out of the cabinet that its back wall will be approximately flush with the front of the cabinet. In the case of drawer guides of another kind, as for example the above-mentioned roller guides, full-length guides are obtained by combining two single guides into so-called "double guides." This recourse, however, is impossible in the case of the drawer guides of the kind here in question for reasons of price. On the other hand, however, in a number of cases, especially in cabinets of great depth, such as kitchen floor cabinets, drawers of less depth than the cabinet are manufactured, and then frequently no drawer guide of the kind here in question is obtainable in the required length, while a longer drawer guide would be available to fit the cabinet. The use of a longer drawer guide would then have even the advantage that an additional extended length is won, i.e., the drawer can be pulled all the way out of the cabinet the same as one with a full-length guide. The runner rail of a lengthened drawer guide then, of course, projects behind the back of the drawer, in which case the problem arises of how to attach this projecting end to the drawer, inasmuch as the runner rail must be removable and must be able to be fastened quickly, easily and removably on the drawer. To fasten the front end of the runner rail at the drawer front, mounting hardware is available (DE-OS 36 32 442). For mounting the projecting rear ends of runner rails, systems have been developed in special cases, but they are limited to those runner rails whose inside end is fastened to the drawer in a particular manner. These are runner rails in which a tongue is stamped from the web of the runner rail and then bent to form a mounting hook by first bending the tongue at right angles out of the web and then bending a portion of it forward at right angles, i.e., to a position parallel to the web. When it is installed on a drawer this hook section parallel to the web is inserted into a corresponding bore in the back of the drawer. In the case of an extended runner rail reaching past the back of the drawer, such a method of fastening is obviously impossible, and therefore in the case of the older solution (DE-OS 36 41 325) a corner fastener is placed on the projecting end of the runner rail and from its front end facing the drawer back a bolt protrudes which can be inserted into the bore serving to accommodate the horizontal section of the above-mentioned hook in the runner rail. In the rear end of the corner fastener, a bore is then again provided, into which the hook formed on the runner rail can be inserted. It is obvious that these corner fasteners must correspond exactly in length to the amount by which the runner rail projects past the drawer back. Since this length is not established, but depends on the length of the drawer, the corner fasteners must be made of a length corresponding in each case to the special application, or cut afterward to the desired length. The applicant has therefore developed mounting hardware of the kind described above, in a proposal not previously disclosed (German Patent Application P 40 12 650.1), in which the runner rail is held on the drawer back by clips by which during assembly it can be pushed through from the drawer back until the front end of the runner rail is held in the associated mounting hardware. The length by which the rear end of the runner rail protrudes is of no importance. Especially in the case of drawers with chambered sides of extruded aluminum, this mounting hardware can be further developed such that it is usable simultaneously also as hardware for joining the drawer side and drawer back by inserting the provided mounting piece on the one hand from the back end into the chamber in the drawer wall extrusion and on the other hand joining it to the end surface of the drawer back which is either also made of a metal extrusion or it is made from wood material.

The invention, on the other hand, is addressed to the problem of devising a corner fastener of this kind which will serve simultaneously as a device for joining the side and back of a drawer and for mounting the rear end of the runner rail of the drawer guides here in question, and which will also be usable on drawers in which both the sides and the back are made of wooden materials.

THE INVENTION

Setting out from a corner fastener of the kind described above, this problem is solved in accordance with the invention in that the fastener has a surface which can be laid flat on the drawer back, from whose marginal portion a flange extends at right angles between the end of the drawer back and the end area of the drawer side inside surface opposite the latter, and in that the flange has means for fastening both to the outside surface of the drawer back and to the inside surface of the side.

The vertical length of the flange is preferably equal to the depth of the corresponding drawer measured from the top of the drawer bottom to the top horizontal surface of the drawer side, the horizontal width of the flange being no more than equal and preferably slightly less than the thickness of the drawer back. The result will be that this flange serving to connect the drawer side to the drawer back will extend over the entire height of the end surfaces to be joined together, while its front edge pointing out of the cabinet interior will reach into the interior of the drawer. Thus, when this flange is fitted into a gain in the rear end part of the drawer side or drawer back, it will not be visible from the inside of the fully assembled drawer.

The flange could be joined to the associated area of the drawer side or back by providing the flange with through bores through which screws are driven into one of the drawer parts to be joined together. Then, of course, the other member of the drawer will no longer be accessible for fastening with screws, so that there a different method of joining must be chosen.

In further development of the invention provision is made so that at least one stud will project from the flat side of the flange facing the drawer side, and can be pressed into an associated blind hole in the drawer side. The corner fastener pre-mounted on the drawer back can then be fastened to the drawer back simply by pressing the drawer side against this or these studs. Since this kind of fastening can be performed simply and quickly it is preferably also used for attaching the corner fastener to the drawer back, by having a stud which projects from the flat side of the flange facing the end of the drawer back, and which can be pressed into a blind hole drilled in the end of the drawer back.

To produce a sufficiently reliable joining of the drawer side and back it is recommended that at least two studs be provided at different levels.

The corner fastener is preferably made of plastic by injection molding in one piece, although multipartite manufacture is basically also conceivable, in which case a part of the corner fastener can be made of metal while the studs are best made of a plastic of sufficient elasticity.

SUMMARY OF THE DRAWINGS

The invention is further explained in the following description of an example of its embodiment, in conjunction with the drawing wherein:

FIG. 3 is a view of the corner fastener seen in the direction of the arrow 3 in FIG. 2, FIG. 4 is a view of the corner fastener seen in the direction of arrow 4 in FIG. 3, FIG. 5 is a view of the corner fastener seen in the direction of arrow 5 in FIG. 4, and FIG. 6 is a view of the corner fastener seen in the direction of arrow 6 in FIG. 3.

DESCRIPTION OF PREFERRED EMBODIMENTS

Figure 1:
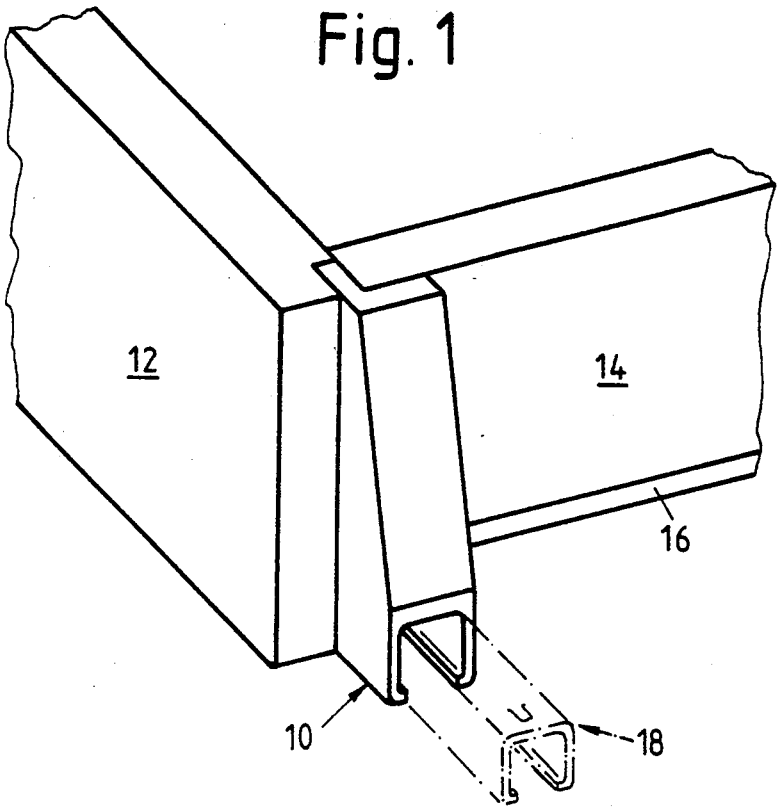
FIG. 1 is a perspective view of the rear corner of a drawer, in which the side and back are joined together by means of a corner fastener according to the invention.
Figure 2:
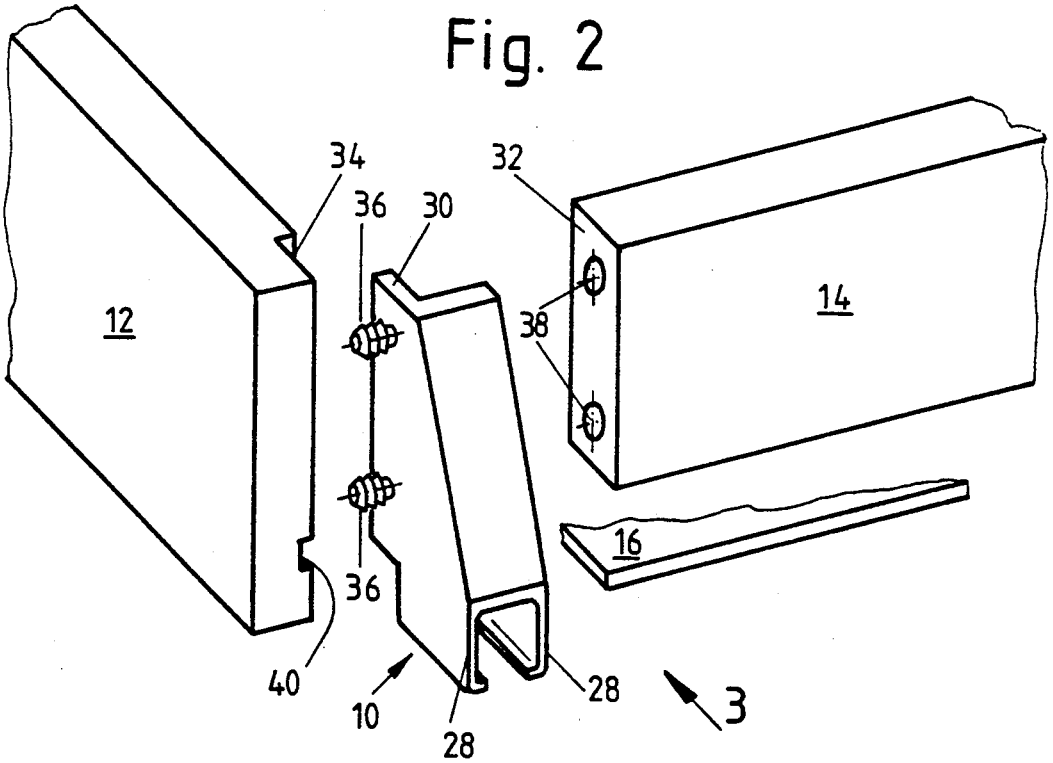
FIG. 2 is an exploded perspective view of the rear corner of the drawer shown in FIG. 1.

FIGS. 1 and 2 show the arrangement of the corner fastener in accordance with the invention, identified as a whole by 10, on a drawer of which only the rear corner is represented, where the drawer side 12 meets the drawer back 14 and the drawer bottom 16. FIG. 1 shows how the runner rail 18—indicated in broken lines—of a drawer guide is mounted in the corner fastener, while FIG. 2 shows the corner fastener and the adjoining walls of the drawer in an exploded view without the runner rail, in order to explain how the drawer side 12 and the drawer back 14 are joined together by the corner fastener.

The corner fastener 10 is shown by itself in FIGS. 2 to 6. It can be seen that the corner fastener 10 has a body portion 26 which can be placed on the drawer back 14, and whose horizontal thickness measured in the direction of movement of the drawer increases downwardly from the top edge of the drawer back 14. At the bottom end the body portion 26 merges with two integrally attached clips 28 projecting downwardly past the drawer bottom 16 when the corner fastener 10 is properly installed on the drawer. These clips grasp the runner rail 18, although the runner rail 18—as it can be seen in FIG. 1—can extend beyond it into the interior of the cabinet.

A flange 30 projects at right angles from one of the vertical surfaces of the body portion 26 which can be placed against the drawer back 14, and its vertical height is substantially equal to the height of the drawer back 14, while its horizontal width is slightly less than the thickness of the drawer back 14. In the properly installed state, this flange 30 is fitted between the end face 32 of the drawer back 14 and a gain 34 whose dimensions match those of the flange 30 and which is created in the rear end portion of the drawer side 12. Two studs 36 project at different levels from the flat sides of the flange 30 associated with the end face 32 of the drawer back 14 and the bottom of the gain 34, and can be pressed into associated blind holes 38 in the drawer back 14 and the drawer side 12. In FIG. 2 only the blind holes 38 made in the end face of the drawer back 14 can be seen, while the corresponding blind holes in the bottom of the gain 34 in the drawer side 12 are concealed due to the manner in which they have been represented. They are, however, to be imagined as being in line with the studs 36 associated with the drawer side 12, which can be seen in this drawing.

The studs 36 can have the configuration known in cabinet hardware, which has circumferential ribs of saw-tooth cross section which, when pressed into the blind hole 38, dig into the material of the wall of the hole and offer high resistance to withdrawal from the blind hole as a result of the inclination of the circumferential saw-tooth ribs.

It can also be seen that the installation of the corner fastener 10 in the back corner of a drawer can take place when the drawer itself is assembled, simply by placing the flange 30 between the gain 34 and the end face 32 and pressing the drawer side 12 and the drawer back 14 against one another, while the studs 36 penetrate into the associated blind holes 38 in the drawer back 14 and the corresponding blind holes in the drawer side 12, and fasten the two parts permanently together. Additional fastening of the corner fastener 10 to the drawer bottom 16 is unnecessary, since the latter enters—as usual—into a longitudinal groove 40 in the drawer sides 12 and is secured against withdrawal from this groove 40 toward the interior of the cabinet by the downwardly projecting clip arms 28.

The corner fastener 10 is, in the depicted case, a one-piece plastic injection molding, although production from metal, such as zinc die-casting metal (Zamak), is not excluded. In that case, however, the studs 36 can best be separately manufactured and installed parts made of elasticized plastic, so as to assure a secure grip in their associated blind holes 38.

It is obvious that modifications and further developments of the described corner fastener are possible within the scope of the invention. For example, one of the pairs of studs 36 can be omitted and replaced by countersunk fastener holes in the flange 30. The corner fastener 10 is then preinstalled on one of the two drawer parts by means of screws passing through these holes, and simply pressed with the studs against the other drawer part. This alternative configuration can be considered especially when the back of the drawer does not have sufficient thickness for the creation of the necessary blind holes.

I claim:

1. Corner fastener for a carcase-interior end of a runner rail of drawer guides in which a guide rail to be fastened to the carcase wall enters from below into the corresponding runner rail formed of an open-bottomed hollow profile to be removably fastened to a drawer beneath the drawer bottom and forms in the interior of the runner rail paths for rolling bodies mounted in an elongated cage, which can roll on the roll paths of the guide rail on the one side and on roll paths formed by associated areas of the inside surface of the runner rail, and thus permit a longitudinal movement of the runner rail relative to the guide rail, a front-end corner fastener which can be fastened under the bottom of the drawer being associated with the front end of the runner rail and in which the front end of the runner rail is held, and the corner fastener that is to be fastened in the back corner of the drawer has two clip arms projecting downward past the underside of the drawer bottom, of which at least one grasps the runner rail, the two clip arms being integral with a body portion which can be fastened in the rear corner area of a corresponding drawer and forms a corner fastener joining together the rear portion of the inside face of a drawer side and the associated end face of the drawer back, wherein the body portion has a surface which can be placed flat upon the outside face of the drawer back, and from the margin of the body portion a vertical flange having two flat sides projects at right angles to be placed between the end face of the drawer back and the rear portion of the inside face of the drawer side to be joined to said end face, and wherein the flange has means for fastening both to the end face of the drawer back and the inside face of the drawer side.

2. Corner fastener according to claim 1, wherein the vertical length of the flange is equal to the clear depth of the corresponding drawer, measured from the top surface of the drawer bottom to the upper horizontal end face of the drawer back.

3. Corner fastener according to claim 1, wherein the horizontal width of the flange is no more than equal to, preferably slightly less than, the thickness of the drawer back.

4. Corner fastener according to claim 1, wherein the fastening means comprises at least one stud which can be pressed into an associated blind hole in the drawer side and which stud projects from the flat side of the flange facing the drawer side.

5. Corner fastener according to claim 4 wherein at least two studs are provided at different vertical positions.

6. Corner fastener according to claim 1, wherein the fastening means comprises at least one stud which can be pressed into an associated blind hole made into the end face of the drawer and which stud projects from the flat side of the flange facing the end face of the drawer back.

7. Corner fastener according to claim 6, wherein at least two studs are provided at different vertical positions.

8. Corner fastener according to claim 1, wherein the fastening means comprises at least one stud which can be pressed into an associated blind hole in the drawer side and which stud projects from the flat side of the flange facing the drawer side and at least one other stud which can be pressed into an associated blind hole made into the end face of the drawer back and which other stud projects from the flat side of the flange facing the end face of the drawer back.

9. Corner fastener according to any one of claims 1 to 6 and 7 to 8, wherein the corner fastener is a one-piece injection molded plastic part.

* * * * *